US005588449A

United States Patent [19]

Falcon

[11] Patent Number: 5,588,449

[45] Date of Patent: Dec. 31, 1996

[54] HAIR ROLLER APPARATUS AND METHOD FOR HIGHLIGHTING HAIR

[76] Inventor: William C. Falcon, 192 E. International Speedway Blvd., Daytona Beach, Fla. 32118

[21] Appl. No.: 475,535

[22] Filed: Jun. 7, 1995

Related U.S. Application Data

[63] Continuation-in-part of Ser. No. 209,973, Mar. 15, 1994, abandoned.

[51] Int. Cl.[6] ..... A61K 7/13; A45D 6/16

[52] U.S. Cl. ..... 132/208; 132/222; 132/252; 132/270; 132/264; 132/265

[58] Field of Search ..... 132/252, 270, 132/222, 208, 242, 264, 265, 267

[56] References Cited

U.S. PATENT DOCUMENTS

| | | | |
|---|---|---|---|
| 1,839,668 | 1/1932 | Gaire | 132/252 |
| 2,750,948 | 6/1956 | Lutz . | |
| 2,910,989 | 11/1959 | Russell | 132/252 |
| 3,084,699 | 4/1963 | Gedid . | |
| 3,376,875 | 4/1968 | Rosan | 132/242 |
| 3,442,271 | 5/1969 | D'Angio . | |
| 3,530,863 | 9/1970 | Foster et al. . | |
| 3,759,271 | 9/1973 | Caruso . | |
| 4,316,476 | 2/1982 | Merges | 132/252 |
| 4,465,084 | 8/1984 | Fulgoni | 132/252 |
| 4,627,452 | 12/1986 | Caruso . | |
| 4,638,821 | 1/1987 | Smith . | |
| 4,936,323 | 6/1990 | Vogelzang et al. | 132/242 |
| 5,299,367 | 4/1994 | Johnson et al. . | |
| 5,365,953 | 11/1994 | Feughelman . | |

FOREIGN PATENT DOCUMENTS

| | | | |
|---|---|---|---|
| 3618414 | 12/1987 | Germany | 132/208 |
| 2253561 | 9/1992 | United Kingdom | 132/208 |

*Primary Examiner*—Todd E. Manahan
*Attorney, Agent, or Firm*—Wenderoth, Lind & Ponack

[57] ABSTRACT

A hair roller apparatus includes a roller member having a roller stem, a roller pad mounted thereabout, and an oblong end flange and a circular end flange at opposing ends of the roller stem. The apparatus also includes a cap member having U-shaped cap body with a short end wall at a first end and a second end wall at a second end. Stem engaging recesses are provided in each of the end walls. Holes are formed in each of the oblong end flange of the roller member and the long end wall of the cap member so that a pin member can be inserted therethrough to secure the cap member against rotation relative to the roller member. A flexible protective sheet is also provided, and includes a slit for feeding hair therethrough. Mutually engageable hook and loop type fastening strips are provided on the outer surface of the cap body and on the flexible protective sheet so that the flexible protective sheet can be securely engaged to the cap body. A method of using the roller apparatus includes separating a section of hair into first and second parts, rolling the first part onto the roller stem, mounting the cap member onto the roller stem, fixing the cap member against rotation relative to the roller stem, feeding the second part of the section of hair through the slit in the flexible protective sheet, and securing the flexible protective sheet to the cap member. These steps are repeated a desired number of times for different section of hair, respectively. Then, after the steps are performed the desired number of times, each of the hair parts exposed through the slit of the protective flexible sheet are chemically treated to provide the desired highlighting effect.

20 Claims, 3 Drawing Sheets

FIG. 1
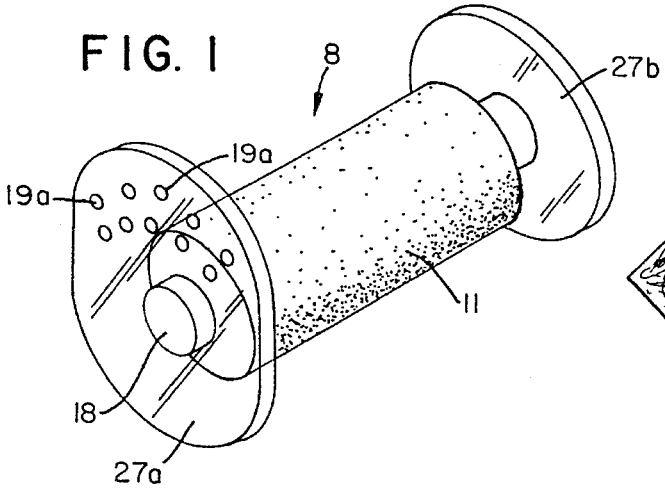
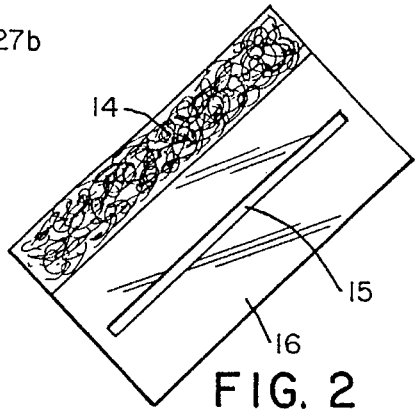
FIG. 2
FIG. 3
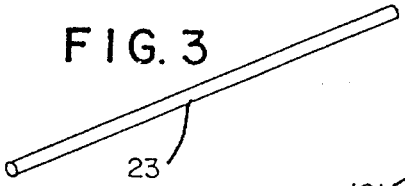
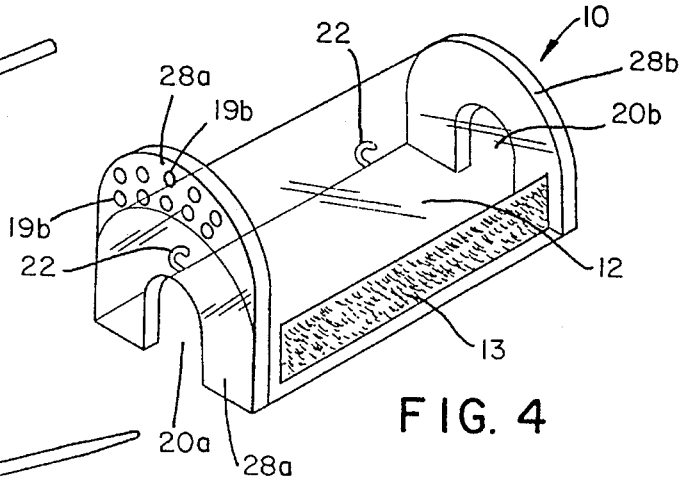
FIG. 4
FIG. 5
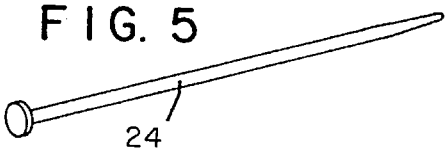

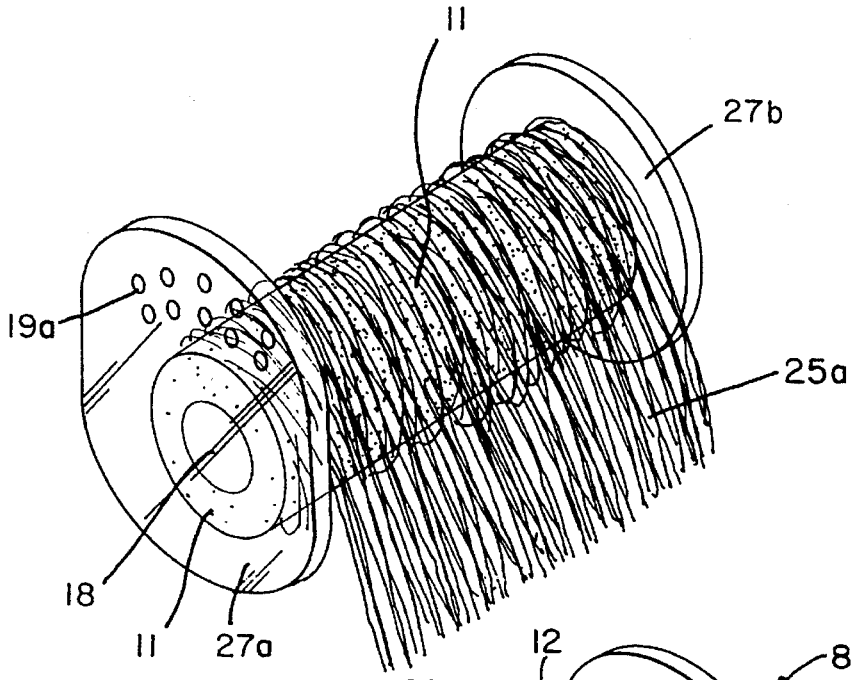
FIG. 6
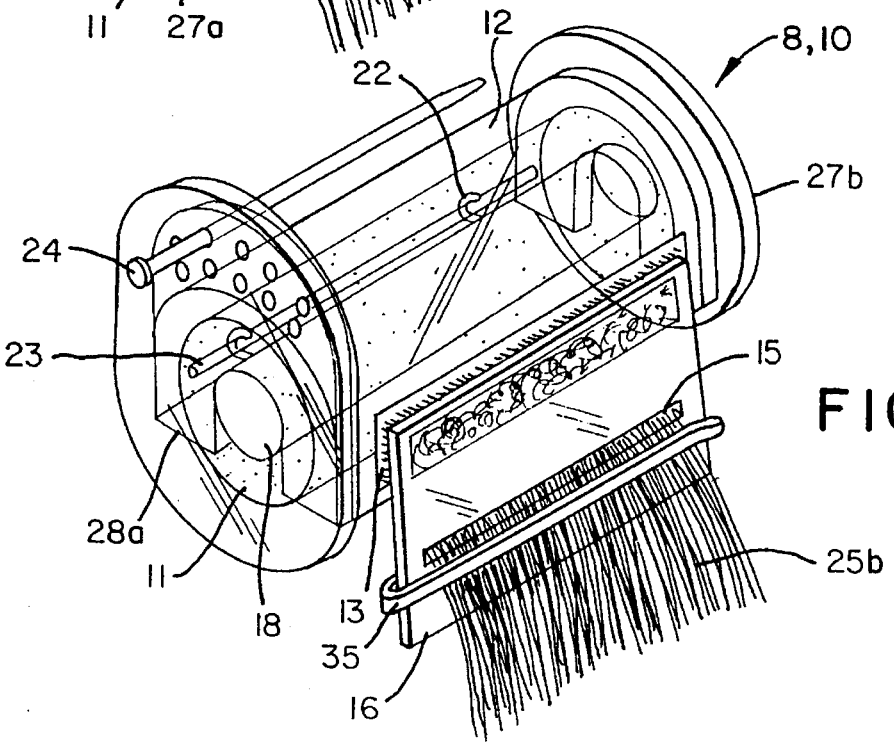
FIG. 7
FIG. 8
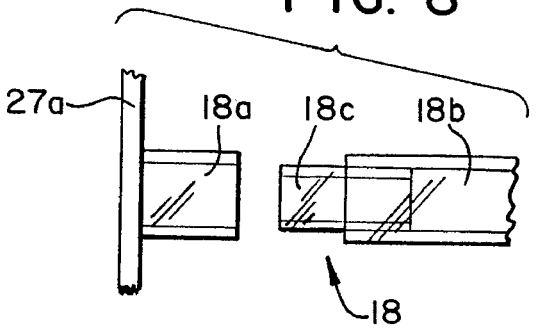

HAIR ROLLER APPARATUS AND METHOD FOR HIGHLIGHTING HAIR

This is a Continuation-In-Part application of Ser. No. 8/209,973, filed Mar. 15, 1994, now abandoned.

BACKGROUND OF THE INVENTION

1. Field of the Invention

The present invention relates generally to a hair roller apparatus having a roller member and a cap member, and more specifically, to a hair roller apparatus for use in highlighting hair by chemical treatment. The present invention also relates to a method of highlighting hair utilizing the hair roller apparatus.

2. Prior Art

Currently, highlighting of hair is carried out by a method in which a section of hair is woven so as to separate the section of hair into two parts, and one of the two parts of the section of hair is chemically treated and then wrapped in an aluminum foil sheet. Once this first section of hair has been woven, separated, chemically treated and wrapped, the same steps are then carried out on a second and subsequent sections of the hair until a desired number of sections of hair have been treated and wrapped with the aluminum foil sheets.

This method is very labor intensive and time consuming, and even for a skilled hair designer, the process will take at least one to two hours. Therefore, with this process, the first section of hair to have been treated with the chemical will have had the chemical thereon for at least one to two hours, which is generally considerably longer than desired, and therefore results in a less than desirable highlighting effect. In addition, the first section of hair to have been chemically treated and wrapped with aluminum foil is treated for a much longer period of time than the last section of hair to have been chemically treated and wrapped with aluminum foil. This causes non-uniform chemical treatment of the various hair sections, thereby also degrading the overall highlighting effect.

Because of the length of time necessary for carrying out this process and the fact that such length of time causes degradation in the overall highlighting effect, it is often necessary for the process to be carried out by two hair dressers. Of course, it is quite cumbersome for two people to work on a single head and, therefore, this method is further inefficient. Therefore, this conventional method is quite expensive, often results in non-uniform results and therefore provides less than desirable highlighting effects. Also, because of the necessity of performing the process with as much speed as possible so as to minimize the non-uniformity of the highlighting and prevent the initial sections of hair from being chemically treated for too long of a time, the process can not be carried out by a non-skilled person.

Another conventional method for highlighting hair involves the use of a hair cap having numerous holes therein, a needle-like tool and the desired treatment chemical. These elements are often sold in kit form for use at home and, therefore, this known method is considerably less expensive than the first-mentioned method. However, this second method is beset by other disadvantages.

In particular, this method is carried out by placing the cap over the hair, inserting the needle-like member through various ones of the holes in the cap, and pulling sections of hair out through the various holes, respectively. After each section of hair is pulled through a hole in the cap, it is chemically treated as desired. Oftentimes, however, the attempts to engage hair within the cap with the needle-like member result in considerable tangling of the hair. In addition, this method results in quite a random highlighting pattern, because it is difficult to pull sections of hair through the holes in the cap according to a specific pattern or in any uniform manner. Therefore, although this latter conventional method is considerably less costly than the first-mentioned method, the highlighting effects are quite random and the overall process is quite cumbersome and results in considerable tangling of the hair.

SUMMARY OF THE INVENTION

Therefore, an object of the present invention is to provide a method, and a hair roller apparatus useful in such method, for highlighting the hair without the above-described disadvantages of the prior art methods and apparatus. Another object of the present invention is to provide a hair roller apparatus for securely rolling and retaining hair in the rolled condition snugly against the scalp.

A further object of the present invention is to provide a hair roller apparatus for use in chemically treating hair and which will protect from the chemical treatment material the portions of the hair which are not to be chemically treated.

According to one aspect of the present invention, a method of highlighting hair is carried out in the following steps: separating a section of hair into first and second parts; rolling the first part of the section of hair onto an elongated roller stem of a hair roller apparatus and holding the elongated roller stem adjacent the scalp; mounting an elongated cap member onto the elongated roller stem so that the elongated roller stem is rotatable relative to the elongated cap member and so as to cover the first part of the section of hair; fixing the elongated cap member against rotation relative to the elongated roller stem so as to prevent the first part of the section of hair from unrolling from the elongated roller stem; feeding the second part of the section of hair through a slit formed in a flexible protective sheet; securing the flexible protective sheet to the elongated cap member; repeating the steps of separating, rolling, mounting, fixing, feeding and securing a desired number of times for different sections of hair, respectively; and after the steps of separating, rolling, mounting, fixing, feeding and securing have been repeated the desired number of times, chemically treating each of the second parts of the sections of hair which have been fed through the slits in the flexible protective sheets, respectively.

In each of the fixing steps, the elongated cap member is fixed against rotation relative to the elongated roller stem by inserting a pin member through a pair of mutually aligned holes respectively formed in an end wall of the elongated cap member and in an end flange of the elongated roller stem.

According to another aspect of the present invention, a hair roller apparatus comprises: an elongated roller stem having first and second opposing ends; a first end flange mounted to the first end of the elongated roller stem; and an elongated cap member removably and rotatably mounted to the elongated roller stem in covering relation to the elongated roller stem. The elongated cap member includes an elongated cap body having first and second ends, and a first end wall mounted to the first end of the elongated cap body. The first end wall of the elongated cap includes an engagement portion. The first end flange includes an engagement portion which is selectively and disengageably securable to the engagement portion of the first end wall.

The engagement portion of the first end wall includes a plurality of spaced apart holes therein. The engagement portion of the first end flange also includes a plurality of spaced apart holes therein, at least one of which is alignable with at least one of the holes of the first end wall. A pin member is provided for removable insertion through mutually aligned ones of the plurality of holes of the first end wall and the plurality of holes of the first end flange, respectively.

The elongated cap body is U-shaped in cross section, and the first end wall has a first stem engaging recess formed therein. The elongated cap member further includes a second end wall mounted to the second end of the elongated cap body, the second end wall having a second stem engaging recess formed therein. The elongated roller stem is removably and rotatably received in the first and second stem engaging recesses of the first and second end walls of the elongated cap member.

A second end flange is mounted to the second end of the elongated roller stem, and this second end flange is circular and projects radially outwardly from the elongated roller stem. The first end flange is oblong and projects radially outwardly from the elongated roller stem, and the first end wall of the elongated cap member protrudes outwardly beyond the elongated cap body in a direction perpendicular to a longitudinal direction of the elongated cap body.

A cylindrical resilient pad is preferably mounted about the elongated roller stem, and the elongated roller stem preferably includes first and second coaxial tubular stem portions rotatably and separably interconnected to one another.

The roller apparatus further includes a flexible protective sheet having first and second ends, a first engagement member provided adjacent the first end of the flexible protective sheet, and a second engagement member, engageable with the first engagement member, provided on an outer surface of the elongated cap body. A slit is formed through the flexible protective sheet at a position between the first engagement member and the second end of the flexible plastic sheet. The first and second engagement members preferably comprise mutually engageable hook and loop fastener strips, respectively.

In a preferred form, the roller apparatus includes hook members fixed to and projecting outwardly from the elongated cap body, and a rod member selectively engageable in the hook members and adapted to have an end of an aluminum foil sheet engaged thereabout.

According to yet another aspect of the present invention, a hair roller apparatus comprises: an elongated roller stem having first and second opposing ends; a first end flange mounted to the first end of the elongated roller stem; an elongated cap member removably and rotatably mounted to the elongated roller stem in covering relation to the elongated roller stem; and wherein the elongated cap member includes an elongated cap body having first and second ends, and a first end wall mounted to the first end of the elongated cap body. A flexible protective sheet is provided and has first and second ends, a first engagement member is provided adjacent the first end of the flexible protective sheet, and a second engagement member, engageable with the first engagement member, provided on an outer surface of the elongated cap body. A slit is formed through the flexible protective sheet at a position between the first engagement member and the second end of the flexible protective sheet.

The first and second engagement members preferably comprise mutually engageable hook and loop fastener strips, respectively.

The elongated cap body is U-shaped in cross section. The first end wall has a first stem engaging recess formed therein. The elongated cap member further includes a second end wall mounted to the second end of the elongated cap body, the second end wall having a second stem engaging recess formed therein. The elongated roller stem is removably and rotatably received in the first and second stem engaging recesses of the first and second end walls of the elongated cap member.

A second end flange is mounted to the second end of the elongated roller stem, and is circular and projects radially outwardly from the elongated roller stem. The first end flange is oblong and projects radially outwardly from the elongated roller stem, and the first end wall of the elongated cap member protrudes outwardly beyond the elongated cap body in a direction perpendicular to a longitudinal direction of the elongated cap body.

The elongated roller stem preferably includes first and second coaxial tubular stem portions rotatably and separably interconnected to one another, as well as a third, smaller diameter, tubular stem portion which is removably received in one of the first and second tubular stem portions.

Hook members are fixed to and project outwardly from the elongated cap body, and a rod member is selectively engageable in the hook members and adapted to have an end of an aluminum foil sheet engaged thereabout.

BRIEF DESCRIPTION OF THE DRAWING FIGURES

The present invention will be further described in detail with reference to the attached drawing figures, wherein FIG. 1 is a perspective view of a roller member of the roller apparatus according to t e present invention;

FIG. 2 shows a flexible protective sheet of the roller apparatus according to the present invention;

FIG. 3 shows a rod member of the roller apparatus according to the present invention;

FIG. 4 is a perspective view of a cap member of the roller apparatus according to t L e present invention;

FIG. 5 shows a pin member of the roller apparatus according to the present invention;

FIG. 6 is a perspective view similar to FIG. 1, except showing the roller member in use with hair wrapped therearound;

FIG. 7 is a perspective view of the overall roller apparatus according to the present invention;

FIG. 8 is an elevation view of a portion of the roller member shown in FIG. 1;

DETAILED DESCRIPTION OF THE INVENTION

Figure 9:
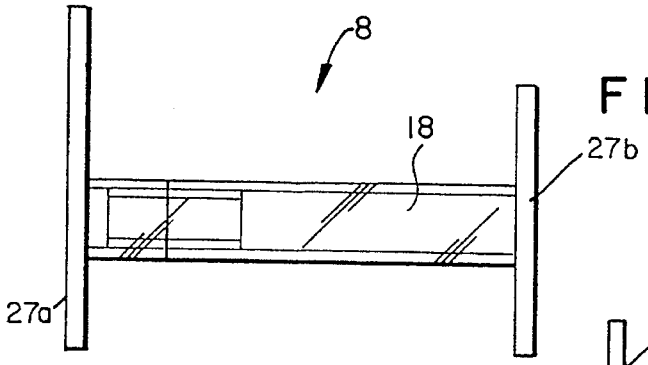
FIG. 9 is an elevation view of a portion of the roller member shown in FIG. 1.

Initially, it is noted that like reference numerals are used throughout the accompanying drawing figures to refer to like elements.

According to the present invention, a roller apparatus is provided and is especially adapted for use in chemically treating hair for the purpose of highlighting the hair by way of bleaching or coloring. The roller apparatus of the present invention is further usable in other endeavors, such as in providing a permanent wave (i.e. a perm) to the hair.

Figure 10:
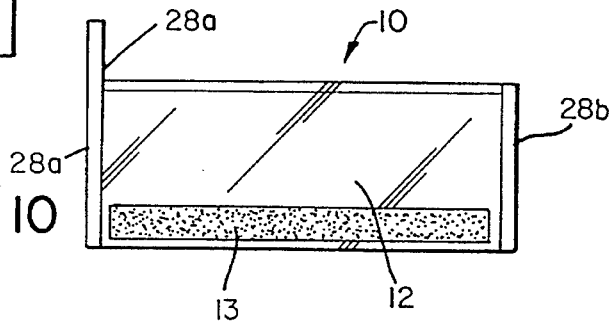
FIG. 10 is a front elevation view of the cap member shown in FIG. 4.
Figure 11:
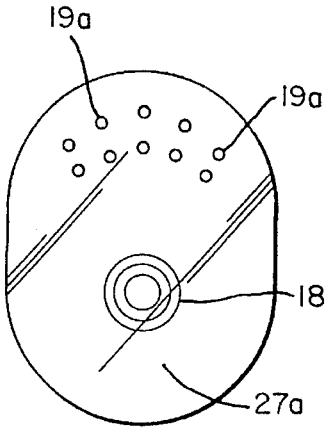
FIG. 11 is a side elevation view of a first end of the roller member according to the present invention.
Figure 12:
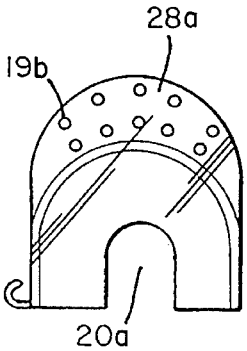
FIG. 12 is a side elevation view of a first end of the cap member according to the present invention.
Figure 13:
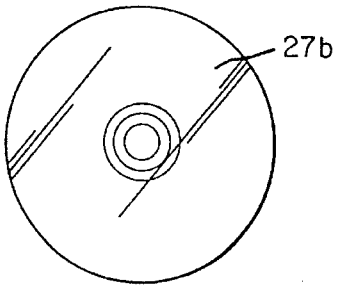
FIG. 13 is a side elevation view of a second end of the roller member according to the present invention.
Figure 14:
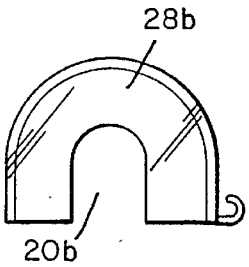
FIG. 14 is a side elevation view of a second end of the cap member according to the present invention.

The hair roller apparatus of the present invention includes a roller member 8 as shown, for example, in FIGS. 1, 6 and 9, and a cap member 10 as shown, for example, in FIGS. 4 and 10. In addition, the roller apparatus of the present invention preferably includes a flexible protective sheet 16 as shown in FIG. 2, a pin member 24 as shown in FIG. 5, and a rod member 23 as shown in FIG. 3.

As shown in FIGS. 1 and 9, the roller member 8 includes an elongated roller stem 18, a first end flange **27*a* fixedly mounted to a first end of the elongated roller stem 18, and a second end flange 27*b* fixedly mounted to a second end of the elongated roller stem 18. The first end flange 27*a* is an oblong end flange so as to include an engagement portion (including a plurality of spaced apart holes 19*a*). The second end flange 27*b*** is preferably a circular end flange.

A tubular roller pad 11 is mounted about the elongated roller stem 18, and is preferably formed of a resilient foam or other resilient material suitable for rolling hair thereon. As shown best in FIGS. 8 and 9, the elongated roller stem 18 includes first and second coaxial tubular stem portions **18*a*, 18*b* rotatably and separably interconnected with one another. Although the separable stem portions 18*a*, 18*b* can be rotatably and separably interconnected with one another by any suitable means, they are preferably interconnected by a third tubular stem portion 18*c* which is smaller in diameter than the first and second stem portions 18*a*, 18*b* and which is fixed to and extending coaxially with the second tubular stem portion 18*b*. The third tubular stem portion 18*c* is selectively insertable into the first tubular stem portion 18*a*. This separable nature of the elongated roller stem 18 allows for the easy mounting of the tubular roller pad 11 onto the elongated roller stem 18, and also allows for the relative rotation of the first (oblong) end flange 27*a* relative to the second (circular) end flange 27*b*. Although in the preferred embodiment the roller pad 11 is not adhered or otherwise positively fixed to the elongated roller stem 18, the roller pad 11 can be adhered to one or the other of the first and second tubular stem portions 18*a*, 18*b* of the elongated roller stem 18 to further prevent unrolling of the hair 25*a* (FIG. 6) once it has been rolled onto the roller member 8**.

As shown in FIGS. 4, 10, 12 and 14, the cap member 10 of the hair roller apparatus of the present invention is elongated and includes an elongated cap body 12 which is substantially U-shaped in cross section. A first end wall **28*a* is fixedly mounted at a first end of the elongated cap body 12, and a second end wall 28*b* is fixedly mounted to a second end of the elongated cap body 12. The first end wall substantially covers a first end of the cap body 12, except for the provision of a U-shaped first stem engaging recess 28*a* formed therein and which is adapted to engage about a first end of the elongated roller stem 18 when the elongated cap member 10** is mounted thereon.

The second end wall **28*b* likewise substantially covers the second end of the cap body 12, except for the provision of the U-shaped second stem engaging recess 20*b*, also adapted to engage about a second end of the elongated roller stem 18 when the elongated cap member 10 is mounted thereon. As shown in FIGS. 4, 10, 12 and 14, the first end wall 28*a* preferably extends outwardly beyond an outer surface of the U-shaped cap body 12 so as to provide an engagement portion including a plurality of spaced apart holes 19*b* therein. On the other hand, the second end wall 28*b* is preferably shaped to conform to the shape of the second end of the U-shaped cap body 12**.

As shown best in FIG. 7, the provision of the holes **19*b* in the first end (wall flange) 28*a* of the cap member 10, and the provision of the holes 19*a* in the first end flange 27*a* of the roller member 8 allows for the insertion of a pin member 24 through both the first end flange 27*a* of the roller member 8 and the first end wall 28*a* of the cap member 10 when at least one pair of the holes 19*a*, 19*b* are mutually aligned. This insertion of the pin 24 through the holes 19*a*, 19*b* substantially prevents relative rotation of the cap member 10 relative to the roller member 8 such that, once hair 25*a* has been rolled onto the roller member 8, it can be secured thereon by the mounting of the cap member 10 onto the roller member 8 and the insertion of the pin member 24 through the holes 19*a*, 19*b*. Although the holes 19*a*, 19*b*** are shown as being spaced apart at substantially equal intervals, it is contemplated that the holes can be spaced apart at uneven or random intervals.

The flexible protective sheet 16 is provided with an elongated slit therein which is an extremely narrow slit, such as a razor slit, so that the slit 15 is substantially self-sealing to prevent treatment chemicals from seeping therethrough even when hair has been fed through the slit 15. As shown in FIG. 7, a bobby pin 35 or the like can also be provided to engage about the flexible protective sheet 16 and the hair **25*b* fed through the slit 15 to aid in the sealing of the slit 15 and further secure the hair. At one end of the flexible protective sheet is provided a hook and loop fastener strip (first engagement member), such as VELCRO. This fastener strip 14 is engageable with a complimentary hook and loop fastener strip (second engagement member) 13 provided on a front outer surface of the cap body 12. Although the fastener strips 13, 14 can be fixed to the cap body 12 and the flexible protective sheet 16** in any suitable manner, they are mounted thereto by an adhesive in the preferred embodiment.

In a preferred form of the present invention, hook members 22 are also provided so as to project outwardly from a rear outer surface of the cap body 12, as shown in FIGS. 4, 7, 12 and 14. These hook members are shaped and sized so as to engage a rod member 23, preferably formed of plastic, which is adapted to have rolled thereon an end of an aluminum foil sheet (not shown) for use in covering chemically treated portions of the hair so as to retain heat to better activate the treatment chemical and speed the treatment process.

In the preferred formed of the present invention, the roller member 8 and cap member 10 are formed of a rigid plastic material which may be a transparent material, but any suitable material, such as a more flexible plastic can be utilized. The pin member 24 and rod member 23 are also preferably formed of plastic, but such is not necessary and they may be formed of other materials. The flexible protective sheet 16 is preferably formed of a flexible plastic material, but can be formed of other flexible materials. Although the various elements of the hair roller apparatus of the present invention can be formed of various materials, it is preferred that, at least the elements which are likely to come into contact with treatment chemicals be formed of a material which is resistant to such chemicals.

In using the hair roller apparatus of the present invention, a section of hair, preferably at the front of the head, is separated into first and second parts, preferably by weaving. Such weaving is carried out, for example, by weaving a needle-like member such as found on a rat-tail comb through a section of hair. In particular, the needle-like member will be alternating inserted upwardly and downwardly through the section of hair whereby groups of preferably 10 or 12 hair are separated from one another. This weaving of the section of hair causes first and second parts of the section of hair to be disposed respectively above and below the needle-like member.

The first part of the section of hair (which is the part which will be highlighted) is clipped and moved forwardly, and the second part of the section of hair (which is the part which will not be highlighted) is rolled onto the roller pad 11 of the roller member 8. After this part of the section of hair is rolled onto the roller member 8, the roller member 8 is brought closely against the scalp, and then, the cap member 10 is mounted onto the roller member 8 with the first and second engaging recesses 20*a*, 20*b* engaging about the elongated roller stem 18, as shown in FIG. 7. Then, a pair of the holes 19*a*, 19*b* in the first end flange 27*a* and first end wall 28*a* are mutually aligned, and the pin member 24 is inserted therethrough so as to substantially prevent rotation of the cap member 10 relative to the roller member 8 and thereby secure these members together so as to prevent unrolling of the hair 25*a* from the hair roller apparatus of the present invention.

Next, the second part of the section of hair which had been clipped off and moved forwardly is fed through the slit 15 formed in the flexible protective sheet 16. The flexible protective sheet 16 is then secured to the elongated cap member 10 by engaging the fastener strip 14 of the flexible protective sheet 16 onto the fastener strip 13 of the cap member 10. The part of the section of hair fed through the slit 15 is fed in a forward direction, and the flexible protective sheet 16 is disposed close to the scalp once the fastener strip 14 is engaged to the fastener strip 13.

This procedure is then repeated using a plural number of the hair roller apparatus of the present invention for various sections of hair, preferably starting at the front of the head and moving rearwardly toward the nape of the neck. After each of the above-discussed steps have been performed for each desired section of hair, a chemical treatment material such as peroxide for bleaching or a hair coloring material is applied onto the part of each section of hair which is exposed through the slit 15 of the flexible protective sheet 16. This chemical treatment step can be performed quite rapidly (e.g. in approximately 10 minutes) for the whole head of hair. After the chemicals have been applied, the hair designer can then simply allow the chemical treatment material to work on the hair for the desired period of time. In a preferred form of the method of treating hair, however, after the chemical treatment material is applied to the exposed hair, a sheet of aluminum foil can be wrapped one to two turns about the rod member 23, and then the rod 23 can be inserted into the hooks 22 so that a flap of aluminum foil extends away from the hooks 22. The aluminum foil extending from the rod 23 can then be folded forwardly over the top of the cap member 10 so as to cover the part of the section of hair which has been chemically treated. This covering of the chemically treated part of the hair will improve the activation of the chemical treatment material and speed the treatment process due to the heat which is retained beneath the aluminum foil sheet.

Although the hair roller apparatus and the method of the present invention have been described in detail with reference to the accompanying drawings, it will be understood by persons of ordinary skill in the art that various modifications and variations to the apparatus and method of the present invention can be made without departing from the spirit and scope of the invention as defined by the appended claims.

I claim:

1. A hair roller apparatus comprising:

an elongated roller stem having first and second opposing ends;

a first end flange mounted to said first end of said elongated roller stem;

an elongated cap member removably and rotatably mounted to said elongated roller stem in covering relation to said elongated roller stem;

wherein said elongated cap member includes an elongated cap body having first and second ends, and a first end wall mounted to said first end of said elongated cap body;

wherein said first end wall of said elongated cap member includes an engagement portion;

wherein said first end flange includes an engagement portion which is selectively and disengageably securable to said engagement portion of said first end wall;

wherein a second end flange is mounted to said second end of said elongated roller stem;

wherein said second end flange is circular and projects radially outwardly from said elongated roller stem;

wherein said first end flange is oblong and projects radially outwardly from said elongated roller stem; and wherein said first end wall of said elongated cap member protrudes outwardly beyond said elongated cap body in a direction perpendicular to a longitudinal direction of said elongated cap body.

2. A hair roller apparatus as recited in claim 1, wherein said engagement portion of said first end wall includes a plurality of spaced apart holes therein;

said engagement portion of said first end flange includes a plurality of spaced apart holes therein, at least one of which is alignable with at least one of said holes of said first end wall; and a pin member is provided for removable insertion through mutually aligned ones of said plurality of holes of said first end wall and said plurality of holes of said first end flange, respectively.

3. A hair roller apparatus as recited in claim 1, wherein said elongated cap body is U-shaped in cross section;

said first end wall has a first stem engaging recess formed therein;

said elongated cap member further includes a second end wall mounted to said second end of said elongated cap body, said second end wall having a second stem engaging recess formed therein; and said elongated roller stem is removably and rotatably received in said first and second stem engaging recesses of said first and second end walls of said elongated cap member.

4. A hair roller apparatus as recited in claim 1, further comprising a cylindrical resilient pad mounted about said elongated roller stem.

5. A hair roller apparatus as recited in claim 1, wherein said elongated roller stem includes first and second coaxial tubular stem portions rotatably and separably interconnected to one another.

6. A hair roller apparatus comprising:

an elongated roller stem having first and second opposing ends;

a first end flange mounted to said first end of said elongated roller stem;

an elongated cap member removably and rotatably mounted to said elongated roller stem in covering relation to said elongated roller stem;

wherein said elongated cap member includes an elongated cap body having first and second ends, and a first end wall mounted to said first end of said elongated cap body;

wherein said first end wall of said elongated cap member includes an engagement portion;

wherein said first end flange includes an engagement portion which is selectively and disengageably securable to said engagement portion of said first end wall;

wherein a flexible protective sheet is provided and has first and second ends;

wherein a first engagement member is provided adjacent said first end of said flexible protective sheet;

wherein a second engagement member, engageable with said first engagement member, is provided on an outer surface of said elongated cap body; and wherein a slit is formed through said flexible protective sheet at a position between said first engagement member and said second end of said flexible protective sheet.

7. A hair roller apparatus as recited in claim 6, wherein said first and second engagement members comprise mutually engageable hook and loop fastener strips, respectively.

8. A hair roller apparatus as recited in claim 6, wherein said elongated cap body is U-shaped in cross section;

said first end wall has a first stem engaging recess formed therein;

said elongated cap member further includes a second end wall mounted to said second end of said elongated cap body, said second end wall having a second stem engaging recess formed therein; and said elongated roller stem is removably and rotatably received in said first and second stem engaging recesses of said first and second end walls of said elongated cap member.

9. A hair roller apparatus as recited in claim 6, further comprising a cylindrical resilient pad mounted about said elongated roller stem.

10. A hair roller apparatus as recited in claim 6, wherein said elongated roller stem includes first and second coaxial tubular stem portions rotatably and separably interconnected to one another.

11. A hair roller apparatus comprising:

an elongated roller stem having first and second opposing ends;

a first end flange mounted to said first end of said elongated roller stem;

an elongated cap member removably and rotatably mounted to said elongated roller stem in covering relation to said elongated roller stem;

wherein said elongated cap member includes an elongated cap body having first and second ends, and a first end wall mounted to said first end of said elongated cap body;

a flexible protective sheet having first and second ends;

a first engagement member provided adjacent said first end of said flexible protective sheet;

a second engagement member, engageable with said first engagement member, provided on an outer surface of said elongated cap body; and wherein a slit is formed through said flexible protective sheet at a position between said first engagement member and said second end of said flexible protective sheet.

12. A hair roller apparatus as recited in claim 11, wherein said first and second engagement members comprise mutually engageable hook and loop fastener strips, respectively.

13. A hair roller apparatus as recited in claim 11, wherein said elongated cap body is U-shaped in cross section;

said first end wall has a first stem engaging recess formed therein;

said elongated cap member further includes a second end wall mounted to said second end of said elongated cap body, said second end wall having a second stem engaging recess formed therein; and said elongated roller stem is removably and rotatably received in said first and second stem engaging recesses of said first and second end walls of said elongated cap member.

14. A hair roller apparatus as recited in claim 13, further comprising a second end flange mounted to said second end of said elongated roller stem;

wherein said second end flange is circular and projects radially outwardly from said elongated roller stem;

wherein said first end flange is oblong and projects radially outwardly from said elongated roller stem; and wherein said first end wall of said elongated cap member protrudes outwardly beyond said elongated cap body in a direction perpendicular to a longitudinal direction of said elongated cap body.

15. A hair roller apparatus as recited in claim 11, further comprising a cylindrical resilient pad mounted about said elongated roller stem.

16. A hair roller apparatus as recited in claim 11, wherein said elongated roller stem includes first and second coaxial tubular stem portions rotatably and separably interconnected to one another.

17. A hair roller apparatus as recited in claim 16, wherein said elongated roller stem further includes a third tubular stem portion which is smaller in diameter than said first and second tubular stem portions, and which is removably received inside one of said first and second tubular stem portions.

18. A hair roller apparatus as recited in claim 11, further comprising hook members fixed to and projecting outwardly from said elongated cap body; and a rod member selectively engageable in said hook members and adapted to have an end of an aluminum foil sheet engaged thereabout.

19. A hair roller apparatus comprising:

an elongated roller stem having first and second opposing ends;

a first end flange mounted to said first end of said elongated roller stem;

an elongated cap member removably and rotatably mounted to said elongated roller stem in covering relation to said elongated roller stem;

wherein said elongated cap member includes an elongated cap body having first and second ends, and a first end wall mounted to said first end of said elongated cap body;

wherein said first end wall of said elongated cap member includes an engagement portion;

wherein said first end flange includes an engagement portion which is selectively and disengageably securable to said engagement portion of said first end wall;

wherein hook members are fixed to and project outwardly from said elongated cap body; and wherein a rod member is selectively engageable in said hook members and is adapted to have an end of an aluminum foil sheet engaged thereabout.

20. A method of highlighting hair comprising the steps of:

separating a section of hair into first and second parts;

rolling said first part of said section of hair onto an elongated roller stem of a hair roller apparatus and holding said elongated roller stem adjacent the scalp;.

mounting an elongated cap member onto said elongated roller stem so that said elongated roller stem is rotatable relative to said elongated cap member and so as to cover the first part of said section of hair;

fixing said elongated cap member against rotation relative to said elongated roller stem so as to prevent the first part of said section of hair from unrolling from said elongated roller stem;

feeding said second part of said section of hair through a slit formed in a flexible protective sheet;

securing said flexible protective sheet to said elongated cap member;

repeating said steps of separating, rolling, mounting, fixing feeding and securing a desired number of times for different sections of hair, respectively;

after said steps of separating, rolling, mounting, fixing, feeding and securing have been repeated said desired number of times, chemically treating each of said second parts of said sections of hair which have been fed through said slits in said flexible protective sheets, respectively; and wherein in each of said fixing steps, said elongated cap member is fixed against rotation relative to said elongated roller stem by inserting a pin member through a pair of mutually aligned holes respectively formed in an end wall of said elongated cap member and in an end flange of said elongated roller stem.

* * * * *